US007632458B2

(12) United States Patent
Crovetto et al.

(10) Patent No.: US 7,632,458 B2
(45) Date of Patent: Dec. 15, 2009

(54) CORROSION INHIBITOR TREATMENT FOR CLOSED LOOP SYSTEMS

(75) Inventors: Rosa Crovetto, Wayne, PA (US); William S. Carey, Wallingford, PA (US); Roger C. May, Warminster, PA (US); Ping Lue, Boothwyn, PA (US); Kristof Kimpe, Beerse (BE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/343,709

(22) Filed: Jan. 31, 2006

(65) Prior Publication Data

US 2007/0178008 A1 Aug. 2, 2007

(51) Int. Cl.
*C23F 11/167* (2006.01)
*C23F 11/14* (2006.01)

(52) U.S. Cl. ..... 422/15; 422/16; 422/17

(58) Field of Classification Search ..... None
See application file for complete search history.

(56) References Cited

U.S. PATENT DOCUMENTS

| | | | | |
|---|---|---|---|---|
| 4,045,253 | A * | 8/1977 | Banks et al. | 148/250 |
| 4,406,811 | A | 9/1983 | Christensen et al. | |
| 4,446,046 | A | 5/1984 | Becker | |
| 4,533,481 | A | 8/1985 | Jahnke | |
| 4,606,890 | A * | 8/1986 | Fisk | 422/15 |
| 4,828,795 | A * | 5/1989 | Cook et al. | 422/15 |
| 4,927,550 | A | 5/1990 | Cutcher et al. | |
| 5,431,834 | A | 7/1995 | Skoeld | |
| 5,519,102 | A | 5/1996 | Cady et al. | |
| 5,531,937 | A | 7/1996 | Minevski et al. | |
| 6,841,125 | B1 * | 1/2005 | Chartier et al. | 422/7 |
| 2005/0032664 | A1 | 2/2005 | Gichuhi et al. | |
| 2007/0001150 | A1 * | 1/2007 | Hudgens et al. | 252/390 |

FOREIGN PATENT DOCUMENTS

| | | | |
|---|---|---|---|
| EP | 0074336 | A1 | 3/1983 |
| EP | 0 176 604 | B1 | 3/1989 |
| EP | 1041174 | A1 | 10/2000 |
| EP | 1 340 840 | A2 | 2/2003 |
| JP | 58206676 | A2 | 12/1983 |
| JP | 60033371 | A | 2/1985 |
| JP | 61117288 | A2 | 6/1986 |
| WO | WO 2006/071996 | A | 7/2006 |

OTHER PUBLICATIONS

Hefter, et. al.; (1997); "Organic corrosion inhibitors in neutral solutions; Part 1-Inhibition of steel, copper, and aluminum by straight chain carboxylates" Corrosion vol. 53, No. 8, pp. 657-667.

Schmitt; (2005); "Corrosion inhibitors in the mirror of five decades" European Corrosion Congress Proceedings 2005, paper No. 099, pp. 1-25.

* cited by examiner

*Primary Examiner*—Elizabeth L McKane
(74) *Attorney, Agent, or Firm*—Duane Morris LLP

(57) ABSTRACT

The present invention provides an effective method of inhibiting corrosion on metallic surfaces in contact with a fluid contained in a closed loop industrial fluid system, which comprises adding to such fluid an effective corrosion controlling amount of a combination of an organic diacid, a triamine and a phosphonate compound.

20 Claims, No Drawings

CORROSION INHIBITOR TREATMENT FOR CLOSED LOOP SYSTEMS

FIELD OF THE INVENTION

The present invention relates generally to a corrosion inhibitor treatment for closed loop systems. More specifically, the present invention relates to an environmentally friendly, non-molybdenum, and non-nitrite corrosion inhibitor treatment for closed loop systems.

BACKGROUND OF THE INVENTION

Corrosion of metallic components in industrial plants may cause system failures and sometimes plant shutdowns. In addition, corrosion products accumulated on the metal surface will decrease the rate of heat transfer between the metal surface and the water or other fluid media, and therefore corrosion will reduce the efficiency of the system operation. Thus, corrosion can increase maintenance and production costs and decrease the life expectancy of the metallic components.

The most common way to combat corrosion is to add corrosion inhibiting additives to the fluid of such systems. However, currently available corrosion inhibiting additives are either non-biodegradable, toxic, or both, which limits the applicability of such additives.

Regulatory pressures have been steadily increasing to eliminate discharge of molybdate and/or nitrite to the environment. Furthermore, nitrite treatments can develop serious microbiological growth in the closed loop. In actuality, the most reliable treatments to eliminate corrosion in closed loop systems are based on molybdate, nitrite or a combination of the two. Existing all-organic treatments do not perform well in systems where corrosion has occurred, and iron and/or iron oxide levels are high, or the water in the closed system has aggressive ions. The water composition as found in closed loops can vary significantly.

Thus, environmental concerns are driving the use of corrosion inhibitors away from heavy metals, molybdenum and nitrite. Existing purely organic treatments, although desirable, are not reliable when applied in iron or iron oxide laden systems or aggressive waters. By their nature, closed loops are prone to have high iron.

Therefore, there is a strong need for an environmentally friendly, non-molybdenum, non-nitrite corrosion inhibitor treatment for closed loop systems. In the present invention, a combination of an organic acid, a triamine and a phosphonate compound surprisingly provides enhanced protection of metallic surfaces from corrosion in closed loop systems. The organic treatments of the present invention can provide good corrosion protection in aggressive water either with or without hardness, and even in corroded systems.

SUMMARY OF THE INVENTION

The present invention provides an effective method of inhibiting corrosion on metallic surfaces in contact with a fluid contained in a closed loop industrial fluid system, which comprises adding to such fluid an effective corrosion controlling amount of a combination of an organic diacid, a triamine and a phosphonate compound. The diacid may be, e.g., sebacic acid. The triamine may be, e.g., triethanolamine, while the phosphonate may be, e.g., a polyisopropenyl phosphonic material of different molecular weights, or e.g., 1,6-hexamethylenediamine-N,N,N',N'-tetra(methylene phosphonic acid), or e.g., N,N,-dihydroxyethyl N',N',-diphosphonomethyl 1,3-propanediamine, N-oxide.

The compositions of the present invention should be added to the fluid system for which corrosion inhibition activity of the metal parts in contact with the fluid system is desired, in an amount effective for the purpose. This amount will vary depending upon the particular system for which treatment is desired and will be influenced by factors such as the area subject to corrosion, pH, temperature, water quantity and respective concentrations in the water of corrosive species. For the most part, the present invention will be effective when used at levels up to about 10,000 parts per million (ppm) of fluid, and preferably from about 2,000-10,000 ppm of the formulation in the fluid contained in the system to be treated. The present invention may be added directly to the desired fluid system in a fixed quantity and in a state of an aqueous solution, continuously or intermittently. The fluid system may be, e.g., a cooling water or boiler water system. Other examples of fluid systems which may benefit from the treatment of the present invention include aqueous heat exchanger, gas scrubber, air washer, air conditioning and refrigeration systems, as well as employed in e.g., building fire protection and water heaters.

DESCRIPTION OF THE PREFERRED EMBODIMENTS

The invention will now be further described with reference to a number of specific examples which are to be regarded solely as illustrative and not as restricting the scope of the present invention.

Local tap water was used for testing, with 60 ppm of Ca (as $CaCO_3$), 20 ppm Mg (as $CaCO_3$), 4 ppm $SiO_2$, and 35 ppm of M-Alk (as $CaCO_3$): This water is identified as TRV. An aggressive water was tested, with 60 ppm of Ca (as $CaCO_3$), 20 ppm of Mg (as $CaCO_3$), 200 ppm of $SO_4$, 4 ppm of $SiO_2$, and 35 M-Alk ppm (as $CaCO_3$): This water is identified as AGG. An aggressive water, but without calcium was also tested (similar to the AGG in composition but without calcium), containing 20 ppm Mg (as $CaCO_3$), 200 ppm $SO_4$, 51 ppm chloride as $Cl^-$, 4 ppm $SiO_2$, and 35 M-Alk ppm as $CaCO_3$: This water is identified as AGG*.

In order to simulate the presence of corrosion products, 3 ppm of initially soluble $Fe^{+2}$ was added to a sample of the aggressive water, AGG: This water is identified as A/Fe. Because a closed system is made of iron pipes, and there is no constant elimination of the naturally occurring iron oxides that are present, a fifth water that could represent those characteristics was also designed. The stress of a highly corroded system was simulated by adding to the local tap water (TRV) a corroded pipe section, an iron oxide in a piece (3 g), 1050 ppm of ground oxide and 4 ppm of initially soluble $Fe^{+2}$: This water is identified as CR or "iron crash test." The iron oxides were taken from actual corroded pipes in the field.

In order to test corrosion, the Corrosion Beaker Test Apparatus (BCTA) was used. The tests were run generally for 18 hours, at 120° F.; beakers were stirred at 400 rpm and open to air. The metallurgy was low carbon steel coupons and probes. The test was based on measuring corrosion through the established electrochemistry technique of linear polarization. The BCTA performed consecutive measurements by automatically multiplexing 12 beakers.

The benchmark product was a molybdate, nitrite combination. In the set of synthetic waters, the corrosion inhibitor was challenged in different ways as the water composition changed, in order to stop corrosion. Note that a good corrosion inhibitor should be able to stop corrosion in all the waters. As shown in Table I below, such is the case for the benchmark molybdate/nitrite combination. The conventional all organic treatment is ineffective in the CR water and in AGG*, aggressive water with no calcium. It is also a weak inhibitor in A/Fe water, or water with dissolved iron.

TABLE I

Corrosion rates measured in different waters, units of mils per year (mpy), for low carbon steel metallurgy with no treatment and with conventional treatments.

| Product or Chemical | ppm | TRV | AGG | AGG* | A/Fe | CR |
|---|---|---|---|---|---|---|
| Control | 0 | 64; 75 | 120; 125; 167 | 94; 94; 85 | 83; 99; 111; 78 | 57; 40; 47; 71 |
| Conventional Molybdate with nitrite | 3000 | <0.05; <0.05 | 0.1; 0.3 | <0.05; <0.05 | 0.2; <0.05 | 0.1; <0.05; <0.05 |
| Conventional all organic | 2000 | 0.1; <0.05 | 0.2; 0.5 | 11; 10 | 2.9; 2.6 | 37 |

Four phosphonates were test ed. Two were experimental phosphonates (A=(N,N-dihydroxyethyl N',N',-diphosphonomethyl 1,3-propanediamine, N-oxide and B=1,6-hexamethylenediamine-N,N,N',N'-tetra(methylene phosphonic acid)); the other two were poly (isopropenyl phosphonic) acid polymers (C is higher molecular weight and made in organic solution, whereas D is made in aqueous media and has smaller molecular weight). Polymers C and D were made as described in U.S. Pat. Nos. 4,446,046 and 5,519,102.

TABLE II

Corrosion rates measured in waters as defined in text, units of mils per year (mpy) for low carbon steel metallurgy for phosphonates and the mixture of diacid amine.

| Chemical | ppm | TRV | AGG | AGG* | A/Fe | CR |
|---|---|---|---|---|---|---|
| Phosphonate A | 10 | 56 | | | | |
| Phosphonate A | 50 | 0.4; 0.9 | 9.2 | 80 | 54 | 54 |
| Phosphonate A | 100 | <0.05 | 4.5 | 17; 34 | 13 | |
| Phosphonate A | 200 | | | 1.1 | | |
| Phosphonate A | 250 | 0.1; <0.05 | 1.5 | | 1.8; 1.8 | 20 |
| Phosphonate A | 300 | | | | 1.1 | |
| Phosphonate A | 500 | 0.1 | | | 0.3 | 10 |
| Phosphonate B | 50 | 0.6; 0.7 | 6 | 5.2 | 9.4 | |
| Phosphonate B | 100 | 0.6 | 1.6 | 1.6; 1.3 | 1.3 | 18 |
| Phosphonate B | 200 | | | | | 16; 12 |
| Phosphonate B | 250 | 0.5 | | | | |
| Phosphonate B | 500 | 0.5 | | | | |
| Phosphonate B | 550 | | | | | 12 |
| Phosphonate C | 25 | 0.6 | 60 | 103 | 58 | |
| Phosphonate C | 50 | 0.2 | 4.6 | 10 | 20 | 33 |
| Phosphonate D | 25 | 1.8; 1.9 | 65 | 91 | | |
| Phosphonate D | 50 | 0.1; 0.3 | 5.2 | 6.1 | 9.4 | 38 |
| Phosphonate D | 75 | | 2.7 | 5.2 | 4.3 | 34 |
| Phosphonate D | 100 | | | | 2.4 | |

TABLE II-continued

Corrosion rates measured in waters as defined in text, units of mils per year (mpy) for low carbon steel metallurgy for phosphonates and the mixture of diacid amine.

| Chemical | ppm/ppm | TRV | AGG | AGG* | A/Fe | CR |
|---|---|---|---|---|---|---|
| Sebacic acid/TEA | 50/50 | 6.6 | | | | |
| Sebacic acid/TEA | 100/100 | 1.4 | | | | |
| Sebacic acid/TEA | 250/250 | <0.05 | 30; 31 | 32 | 26 | 62; 60 |
| Sebacic acid/TEA | 500/500 | <0.05; <0.05 | 47 | 46 | 38 | <0.05; <0.05 |

As shown in Table II, in order to obtain corrosion inhibition in the CR water, the preferred diacid is sebacic acid, at a concentration of at least 500 ppm. The preferred amine is triethanol amine (TEA). The preferred mass ratio of diacid (e.g., sebacic) to amine is at least 1:1. An increase of the concentrations of sebacic acid/TEA does not provide corrosion inhibition in all the synthetic waters. The worst protection is in the AGG, AGG* and A/Fe synthetic waters. As shown in Table II, in TRV and CR waters, sebacic acid/TEA at 500 ppm/500 ppm provides good corrosion protection, i.e., less than 0.05 mpy, in such waters. This is in contrast to its performance in AGG, AGG* and A/Fe waters; in those waters, corrosion protection is on the order of greater than 38 mpy.

Phosphonates are known to be useful corrosion inhibitors. However, as shown in Table II, none of the phosphonates tested offered effective corrosion protection for the CR water. The performance in the other synthetic waters was less effective than the benchmark; increasing their concentration did not radically change performance, especially in the CR water.

TABLE III

Corrosion rates measured in waters as defined in text, units of mils per year (mpy) for low carbon steel metallurgy for the synergetic mixtures of phosphonates and diacids/amine.

| Phosphonate | ppm | Diacid/amine | ppm/ppm | TRV | AGG | AGG* | A/Fe | CR |
|---|---|---|---|---|---|---|---|---|
| A | 75 | Sebacic/TEA | 500/500 | <0.05 | 0.1 | 0.1 | 0.9 | <0.05 |
| A | 50 | Sebacic/TEA | 500/500 | | <0.05 | 0.05 | 0.05 | 0.1 |

TABLE III-continued

Corrosion rates measured in waters as defined in text, units of mils per year (mpy) for low carbon steel metallurgy for the synergetic mixtures of phosphonates and diacids/amine.

| Phosphonate | ppm | Diacid/ amine | ppm/ppm | TRV | AGG | AGG* | A/Fe | CR |
|---|---|---|---|---|---|---|---|---|
| B | 30 | Sebacic/ TEA | 500/ 500 | <0.05; <0.05 | <0.05; 1.5 | | | |
| B | 50 | Sebacic/ TEA | 500/ 500 | <0.05 | 0.05 | <0.05 | 0.1 | <0.05 |
| C | 50 | Sebacic/ TEA | 500/ 500 | <0.05 | <0.05; <0.05 | <0.05; <0.05; 0.1 | <0.05; <0.05 | 0.05; 0.1 |
| D | 50 | Sebacic/ TEA | 500/ 500 | <0.05 | 0.05; <0.05 | 0.1 | | <0.05 |

As shown in Table III, it was found that the combination of organic diacid/triamine with any of the four phosphonates tested provided excellent corrosion protection in all the synthetic waters, when sebacic acid/triethanol amine are at least at 500 ppm of each and the phosphonates are at least 50 ppm as actives. The performance achieved at the above mentioned concentrations in the AGG, AGG* and A/Fe synthetic waters is unexpected and can be explained by a synergistic effect of the mixtures. Please note that none of the individual components can give protection of greater than 90% in that set of waters, and the combination provides protection of equal or greater than 99.9%. Table IV further demonstrates the unexpected results of the combination of diacid/amine/phosphonate, wherein a comparison of the corrosion rates in mpy as measured and as predicted is presented. The predicted corrosion rate is: a) calculated averaging the corrosion rates of the individual inhibitors phosphonate and diacid/amine, b) the corrosion rate as obtained with the best performer of the two, and c) calculated assuming a decrease in the corrosion rate of the best performer as the reduction on the rate of corrosion between the control water and the same water treated by the other inhibitor.

TABLE IV

| mpy as | TRV | AGG | AAG* | A/Fe | CR |
|---|---|---|---|---|---|
| Phosphonate A 50 ppm, sebacic acid 500 ppm, triethanol amine 500 ppm. | | | | | |
| Measured | | <0.05 | 0.05 | 0.05 | 0.1 |
| Predicted by a) | 0.35 | 28.1 | 63 | 46 | 27 |
| Predicted by b) | <0.05 | 9.2 | 46 | 9.4 | <0.05 |
| Predicted by c) | <0.05 | 3.1 | 40.4 | 22.1 | <0.05 |
| Phosphonate B 50 ppm, sebacic acid 500 ppm, triethanol amine 500 ppm. | | | | | |
| Measured | <0.05 | 0.05 | <0.05 | 0.1 | <0.05 |
| Predicted by a) | 0.35 | 26.5 | 25.5 | 23.7 | 15 |
| Predicted by b) | <0.05 | 6 | 5.2 | 9.4 | <0.05 |
| Predicted by c) | <0.05 | 2.1 | 2.6 | 3.9 | <0.05 |
| Phosphonate C 50 ppm, sebacic acid 500 ppm, triethanol amine 500 ppm. | | | | | |
| Measured | | <0.05; <0.05 | <0.05; <0.05; 0.1 | <0.05; <0.05 | <0.05; 0.1 |
| Predicted by a) | 0.1 | 25.8 | 28 | 29 | 16.5 |
| Predicted by b) | <0.05 | 9.2 | 46 | 9.4 | <0.05 |
| Predicted by c) | <0.05 | 1.6 | 5.1 | 8.2 | <0.05 |

TABLE IV-continued

| mpy as | TRV | AGG | AAG* | A/Fe | CR |
|---|---|---|---|---|---|
| Phosphonate D 50 ppm, sebacic acid 500 ppm, triethanol amine 500 ppm. | | | | | |
| Measured | <0.05 | <0.05; <0.05 | <0.05; <0.05 | 0.1 | <0.05 |
| Predicted by a) | 0.1 | 26.1 | 26.1 | 23.7 | 19 |
| Predicted by b) | <0.05 | 5.2 | 6.1 | 9.4 | <0.05 |
| Predicted by c) | <0.05 | 1.8 | 3.1 | 3.9 | <0.05 |

As shown in Table IV, none of the predictions can account for the measured results. The nearest is the prediction by method c), but even by this prediction, the corrosion rate is still at least 30 times larger than any of the measured ones.

In a preferred embodiment, from about 200-1,000 ppm of sebacic acid, about 200-1,000 ppm of triethanolamine and about 25-100 ppm of polyisopropenyl phosphonic material may be added to the system in need of treatment. The polyisopropenyl phosphonic material may be made in organic solution or aqueous media.

While this invention has been described with respect to particular embodiments thereof, it is apparent that numerous other forms and modifications of this invention will be obvious to those skilled in the art. The appended claims in this invention generally should be construed to cover all such obvious forms and modifications which are within the true spirit and scope of the present invention.

What is claimed is:

1. A method of inhibiting carbon steel corrosion on metallic surfaces in contact with a fluid contained in a closed loop industrial fluid system, which consists essentially of adding to said fluid an effective corrosion controlling amount of a combination of an organic diacid, a triamine and a phosphonate, wherein said treated fluid is in long-term, continuous contact with said metallic surfaces, and said closed loop industrial fluid system may contain iron, iron oxide or aggressive waters.

2. The method as recited in claim 1, wherein said diacid is sebacic acid.

3. The method as recited in claim 2, wherein from about 200-1,000 ppm of sebacic acid is added to the fluid.

4. The method as recited in claim 1, wherein said triamine is triethanolamine.

5. The method as recited in claim 4, wherein from about 200-1,000 ppm of triethanolamine is added to the fluid.

6. The method as recited in claim 1, wherein the phosphonate is N, N,-dihydroxyethyl N', N',-diphosphonomethyl 1, 3-propanediamine, N-oxide or 1, 6-hexamethylenediamine-N,N,N',N'-tetra(methylene phosphonic acid).

7. The method as recited in claim 1, wherein the phosphonate is a polyisopropenyl phosphonic material.

8. The method as recited in claim 7, wherein from about 25-100 ppm of polyisopropenyl phosphonic material is added to the fluid.

9. The method as recited in claim 7, wherein the polyisopropenyl phosphonic material may be made in organic solution or aqueous media.

10. The method as recited in claim 1, wherein said fluid system is an aqueous, closed loop heat exchanger system.

11. The method as recited in claim 1, wherein said fluid system is a low pressure boiler system.

12. The method as recited in claim 1, wherein said fluid system is a gas scrubber or air washer system.

13. The method as recited in claim 1, wherein said fluid system is an air conditioning and refrigeration system.

14. The method as recited in claim 1, wherein said fluid system is employed in building fire protection and water heating systems.

15. The method as recited in claim 1, wherein said combination is added to said fluid in an amount of from about 2,000-10,000 ppm of fluid.

16. A method of inhibiting carbon steel corrosion on metallic surfaces in contact with a fluid contained in a closed loop industrial fluid system, which consists essentially of adding to said fluid an effective corrosion controlling amount of a combination of an organic diacid, a triamine and a phosphonate, wherein said treated fluid is in long-term, continuous contact with said metallic surfaces, and there is no elimination of naturally occurring iron oxides present in said closed loop industrial fluid system.

17. The method as recited in claim 16, wherein said diacid is sebacic acid.

18. The method as recited in claim 16, wherein said triamine is triethanolamine.

19. The method as recited in claim 16, wherein the phosphonate is N, N,-dihydroxyethyl N', N',-diphosphonomethyl 1, 3-propanediamine, N-oxide or 1, 6-hexamethylenediamine-N,N,N',N'-tetra(methylene phosphonic acid).

20. The method as recited in claim 16, wherein the phosphonate is a polyisopropenyl phosphonic material.

* * * * *